US008509471B2

(12) United States Patent
Shibata

(10) Patent No.: US 8,509,471 B2
(45) Date of Patent: Aug. 13, 2013

(54) SPEAKER DEVICE

(75) Inventor: Kiyosei Shibata, Kobe (JP)

(73) Assignee: Fujitsu Ten Limited, Kobe (JP)

( * ) Notice: Subject to any disclaimer, the term of this patent is extended or adjusted under 35 U.S.C. 154(b) by 32 days.

(21) Appl. No.: 13/141,602

(22) PCT Filed: Sep. 25, 2009

(86) PCT No.: PCT/JP2009/066624
§ 371 (c)(1),
(2), (4) Date: Jun. 22, 2011

(87) PCT Pub. No.: WO2010/073786
PCT Pub. Date: Jul. 1, 2010

(65) Prior Publication Data

US 2011/0261991 A1 Oct. 27, 2011

(30) Foreign Application Priority Data

Dec. 25, 2008 (JP) ..... 2008-329657

(51) Int. Cl.
*H04R 1/00* (2006.01)

(52) U.S. Cl.
USPC ..... 381/412; 381/124; 381/397; 381/421; 381/189; 381/389

(58) Field of Classification Search
USPC ..... 381/421, 189, 389, 420, 419
See application file for complete search history.

(56) References Cited

U.S. PATENT DOCUMENTS 2,346,429 A * 4/1944 Harrison ..... 367/175
3,109,072 A * 10/1963 Price ..... 381/416
6,724,909 B2 * 4/2004 Tsumori et al. ..... 381/412
6,944,311 B2 * 9/2005 Nishikawa et al. ..... 381/389
7,068,807 B2 * 6/2006 Kobayashi ..... 381/412
2002/0057821 A1 5/2002 Tsumori et al.
2003/0228022 A1 12/2003 Nishikawa et al.

(Continued)

FOREIGN PATENT DOCUMENTS

JP A-62-38100 2/1987
JP 63-283399 * 11/1988

(Continued)

OTHER PUBLICATIONS

International Search Report mailed Oct. 27, 2009 issued in International Patent Application No. PCT/JP2009/066624 (with translation).

*Primary Examiner* — Suhan Ni
*Assistant Examiner* — Thomas Maung
(74) *Attorney, Agent, or Firm* — Oliff & Berridge, PLC

(57) ABSTRACT

A speaker device, wherein vibration of a magnetic circuit section is suppressed with a magnetic influence on the magnetic circuit section suppressed. A speaker device having a vibration section and generating an audio sound by vibration of the vibration section is provided with a magnetic circuit section for forming a magnetic field for vibrating the vibration section and also with a weight section fixed to the magnetic circuit section and suppressing vibration of the magnetic circuit section subjected to reaction force caused by vibration of the vibration section. The weight section is fixed to the magnetic circuit section through a joint section for joining the magnetic circuit section and the weight section to each other, and this forms between the magnetic circuit section and the weight section a predetermined space for magnetically separating the magnetic circuit section and the weight section from each other.

6 Claims, 7 Drawing Sheets

(56) References Cited

U.S. PATENT DOCUMENTS

| | | | | |
|---|---|---|---|---|
| 2004/0165738 | A1 | 8/2004 | Tsumori et al. | |
| 2004/0165744 | A1* | 8/2004 | Tsumori et al. | 381/345 |
| 2006/0153413 | A1* | 7/2006 | Nakajima et al. | 381/345 |

FOREIGN PATENT DOCUMENTS

| | | |
|---|---|---|
| JP | A-63-283399 | 11/1988 |
| JP | U-6-26394 | 4/1994 |
| JP | U-3008172 | 3/1995 |
| JP | A-11-146471 | 5/1999 |
| JP | Y2-2598980 | 8/1999 |
| JP | Y2-2603679 | 3/2000 |
| JP | A-2002-152884 | 5/2002 |
| JP | A-2004-015566 | 1/2004 |
| JP | A-2005-5934 | 1/2005 |

* cited by examiner

SPEAKER DEVICE

TECHNICAL FIELD

The present invention relates to a speaker device which produces a sound.

BACKGROUND ART

In the speaker device, in principle, a diaphragm is vibrated by a magnetic field given from a magnetic circuit unit including a magnet and by an electric current flowing through a voice coil, thereby producing the sound. Herein, the magnetic circuit unit serves to vibrate, so to speak, the diaphragm and is installed, it is desired, fixedly with respect to the vibrations of the diaphragm. In fact, however, when driving the speaker, repulsion from the diaphragm forces the magnetic circuit unit itself to be set in some sort of vibrating state, and a sound quality of the speaker device declines as the case may be.

Such being the case, a technology (refer to, e.g., Patent document 1) is proposed, which suppresses the vibrations of the magnetic circuit unit by additionally fitting an anchor to the magnetic circuit unit in order to suppress the vibrations of the magnetic circuit unit that are caused by the repulsion. This technology has a scheme of restraining the decline of the sound quality of the speaker device by additionally fitting the iron-made anchor taking a bowl-like shape to the magnetic circuit unit of the speaker device.

Further, with a rapid spread of the electronic devices of nowadays, the electronic devices disposed adjacent to the speaker device continue to rise in their numbers. Therefore, a technology (refer to, e.g., Patent document 2) is proposed, which restrains the peripheral electronic devices from being affected by the magnetism leaking from the speaker device in a way that controls this magnetism. This technology has a scheme of controlling the magnetism leaking from the speaker device by interposing a magnetic resistance material between a magnetic shielding magnet and a shield cover.

[Patent document 1] Japanese Patent Laid-Open Publication No. 2002-152884

[Patent document 2] Japanese Patent Laid-Open Publication No. S62-38100

DISCLOSURE OF THE INVENTION

Problems to be Solved by the Invention

The conventional speaker device, in the case of additionally providing a magnetic circuit unit with an anchor in order to improve the sound quality, has a scheme of effectively suppressing the vibrations of the magnetic circuit unit by adopting the anchor having a large mass. Metallic materials can be exemplified as high-mass materials capable of effectively suppressing the vibrations of the magnetic circuit unit, however, the great majority of metallic materials are classified into ferromagnetic substances, and hence, if used for the anchor, affection on the magnetism of the magnetic circuit unit is a matter of concern.

It is an object of the present invention, which was devised in view of such problems, to provide a speaker device which suppresses vibrations of a magnetic circuit unit while restraining the magnetic affection on the magnetic circuit unit.

Means for Solving the Problems

According to the present invention, a solution for the problem described above is that an anchor portion is fixed to a magnetic circuit unit via a joint portion which joins the magnetic circuit unit and the anchor portion together so as to form a predetermined space for magnetically separating the magnetic circuit unit and the anchor portion from each other. Specifically, the present invention is a speaker device having a vibration unit and producing a sound by vibrations of said vibration unit, comprising: a magnetic circuit unit to generate a magnetic field for vibrating said vibration unit; and an anchor portion to be fixed to said magnetic circuit unit and to restrain the vibrations of said magnetic circuit unit receiving reaction force caused by the vibrations of said vibration unit, wherein said anchor portion is fixed to said magnetic circuit unit via a joint portion which joins said magnetic circuit unit and said anchor portion together in a way that forms a predetermined space for magnetically separating said magnetic circuit unit and said anchor portion from each other between said magnetic circuit unit and said anchor portion.

The speaker device described above, in the magnetic field generated by the magnetic circuit unit, produces the sound by the vibrations of the vibration unit. Herein, the vibration unit, which vibrates the air and thus produces the sound, has a mass itself, and therefore it follows that the vibrations are inevitably given to the magnetic circuit unit which vibrates the vibration unit. When the magnetic circuit unit gets vibrating by dint of a reaction force given from the vibration unit, a driving force transferred to the vibration unit from the magnetic circuit unit is attenuated with the result that the sound quality is degraded, and therefore the anchor portion is fixed to the magnetic circuit unit in order to suppress this attenuation. This anchor portion has a mass that is enough to resist the repulsion received by the magnetic circuit unit due to the vibrations of the vibration unit and is capable of contributing to maintain the sound quality of the speaker device.

Herein, the speaker device is configured so that the anchor portion is fixed via the joint portion to the magnetic circuit unit, thereby transferring the vibrations of the magnetic circuit unit to the anchor portion. This joint portion serves to joint the magnetic circuit unit and the anchor portion together in a state where the predetermined space for magnetically separating the magnetic circuit unit and the anchor portion from each other is formed between these two components. The anchor portion is fixed to the magnetic circuit unit via this type of joint portion and is thereby enabled to suppress the vibrations of the magnetic circuit unit in the state where the magnetic circuit unit and the anchor portion are magnetically separated from each other. Accordingly, the vibrations of the magnetic circuit unit can be suppressed while restraining the magnetic affection of the magnetic circuit unit due to the fixation of the anchor portion to the magnetic circuit unit. It should be noted that the predetermined space herein connotes a magnetic space formed between the magnetic circuit unit and the anchor portion and is, e.g., a space for magnetically insolating the magnetic circuit unit and the anchor portion from each other.

Further, the vibration unit may further includes a coil through which electric sound signals flow, the magnetic circuit unit may further includes a magnet portion and a yoke portion to guide a magnetic flux of said magnet portion to a space in which said coil is disposed, and the anchor portion may be fixed to said magnetic circuit unit in a state of the predetermined space being formed via said joint portion which joins said magnetic circuit unit and said anchor portion together in such a state that a spacer composed of a nonmagnetic material is interposed between said yoke portion and said anchor portion. If the speaker device is thus configured, the yoke portion is jointed to the anchor portion with the spacer being interposed therebetween, and hence the reaction force propagated to the yoke portion from the vibration unit is transferred to the anchor portion via the spacer, thus effectively suppressing the vibrations of the magnetic circuit unit. Further, since the anchor portion is fixed to the magnetic circuit unit via the nonmagnetic substance, it is feasible to suppress the vibrations of the magnetic circuit unit while restraining the magnetic affection on the magnetic circuit unit.

Further, the anchor portion may be fixed to said magnetic circuit unit in such a state that a distance between said magnetic circuit unit and said anchor portion is adjusted based on a correlation between an intensity of the magnetic field generated in the space where said coil is disposed and a vibration suppressing effect of said magnetic circuit unit, depending on a length of said spacer in a direction of extending to said anchor portion from said magnetic circuit unit. If the speaker device is thus configured, a minute adjustment can be made in terms of optimizing the sound quality of the speaker in a way that keeps a balance between countervailing elements such as relaxing the affection of the magnetic field on the magnetic circuit unit due to the anchor portion being spaced from the magnetic circuit unit and suppressing the vibrations due to the anchor portion being fixed in close proximity to the magnetic circuit unit, thereby providing easy-to-handle flexibility to dispersion in acoustic characteristics on a per-product basis.

Further, the vibration unit may further includes a coil through which electric sound signals flow, the magnetic circuit unit may further includes a magnet portion and a yoke portion to guide a magnetic flux of said magnet portion to a space in which said coil is disposed, and the anchor portion may be fixed to said magnetic circuit unit in a state of the predetermined space being formed between said magnetic circuit unit and said anchor portion via said joint portion which joins said magnetic circuit unit and said anchor portion together in such a state that a magnetic shielding portion to restrain a magnetic flux leaking from said magnetic circuit unit is interposed between said yoke portion and said anchor portion. If the speaker device is thus configured, the yoke portion is joined to the anchor portion with the magnetic shielding portion being interposed therebetween, and therefore the reaction force propagated to the yoke portion from the vibration unit is transferred to the anchor portion via the magnetic shielding portion, thereby effectively suppressing the vibrations of the magnetic circuit unit. Moreover, the magnetic shielding portion is interposed between the magnetic circuit unit and the anchor portion so that the magnetic field of the magnetic circuit unit is not affected by the anchor portion, whereby the vibrations of the magnetic circuit unit can be effectively suppressed while restraining the magnetic affection on the magnetic circuit unit.

Further, the anchor portion may be fastened to said magnetic circuit unit by a screw composed of a nonmagnetic material. If the speaker device is thus configured, the magnetic circuit unit and the anchor portion firmly joined together via the screw, and consequently the vibrations of the magnetic circuit unit are surely transferred to the anchor portion, and besides the magnetic affection on the magnetic circuit unit can be suppressed.

Effects of the Invention

It is feasible to provide the speaker device which suppresses the vibrations of the magnetic circuit unit while restraining the magnetic affection on the magnetic circuit unit.

DESCRIPTION OF THE REFERENCE NUMERALS AND SYMBOLS

Figure 1:
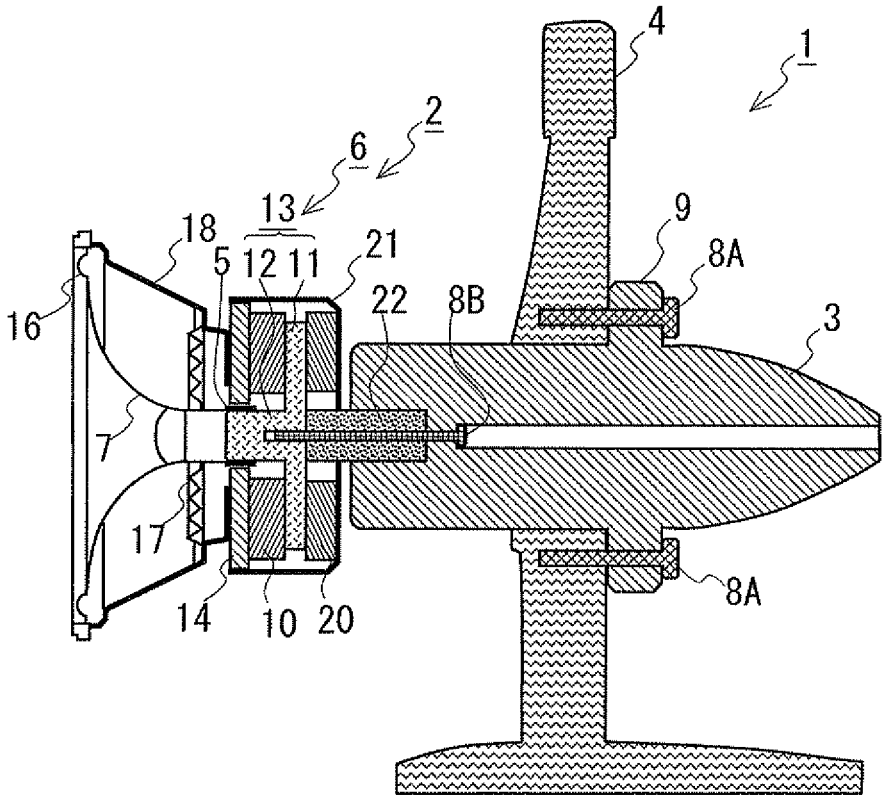
FIG. 1 A view of an internal structure of a speaker device according to a first embodiment.

1, 51, 101 . . . speaker device
2 . . . speaker unit
3, 52, 102 . . . anchor
6 . . . magnetic circuit unit
7 . . . diaphragm
8A, 8B . . . fixing screw
10 . . . main magnet
11 . . . yoke
15 . . . gap
20 . . . cancel magnet
22, 103 . . . spacer

EMBODIMENTS FOR CARRYING OUT THE INVENTION

Embodiments of the present invention will hereinafter be discussed. It should be noted that each of the following embodiments will be demonstrated on an exemplifying and not-limiting basis by way of a specific embodiment of the present invention but does not limit the scope of the right of the present invention.

FIG. 1 is a view illustrating an internal structure of a speaker device 1 as viewed from the right side according to a first embodiment. The speaker device 1 includes, as depicted in FIG. 1, a speaker unit 2 which converts electric signals into voices, an anchor 3 (corresponding to an anchor portion according to the present invention) which suppresses vibrations of the speaker unit 2, and a stay 4 which supports these components. The speaker unit 2 is basically the same as a general type of hitherto-available speaker, in which a voice coil 5 vibrates a diaphragm 7 (corresponding to a vibration unit according to the present invention) by utilizing a magnetic field of a magnetic circuit unit 6, with the result that the diaphragm 7 vibrates the air, thus producing a sound. The speaker unit 2 couples on its rear surface side with the anchor 3, whereby the vibrations of the diaphragm 7 are propagated directly to the anchor 3. The speaker unit 2 is coupled via the anchor 3 to the stay 4 and is thereby supported.

The anchor 3 is an iron-made anchor taking a cylindrical shape with its one end being tapered and is fixed to the stay 4 so that the tapered side is directed toward the rear surface of the speaker device 1, while the other side coupled to the speaker unit 2 is directed toward the front surface. A reason why the anchor 3 is composed of iron is that the iron is superior to materials such as stainless steel in terms of a cost and workability. The anchor 3 has a mass required for suppressing unnecessary vibrations of the magnetic circuit unit 6 due to repulsion given from the diaphragm 7. The anchor 3 is jointed to a yoke 11 of the magnetic circuit unit 6 to attain an integral structure, thereby suppressing the unnecessary vibrations of the magnetic circuit unit 6. Note that an outer peripheral surface of the anchor 3 is provided with a flange 9 having holes into which fixing screws 8A for the coupling with the stay 4 are inserted, and a portion of the central axis of the anchor 3 is formed with a hole into which to insert a fixing screw 8B (corresponding to a joint portion according to the present invention) for fixing the speaker unit 2. The anchor 3 is fitted into the hole of the stay 4, whereby the flange 9 abuts on the rear surface of the stay 4. The anchor 3 is fixed to the stay 4 in this state by driving the fixing screws 8A. Note that the anchor 3 may be formed integrally with the stay 4 as well as being joined to the stay 4 via the fixing screws 8A.

Figure 2:
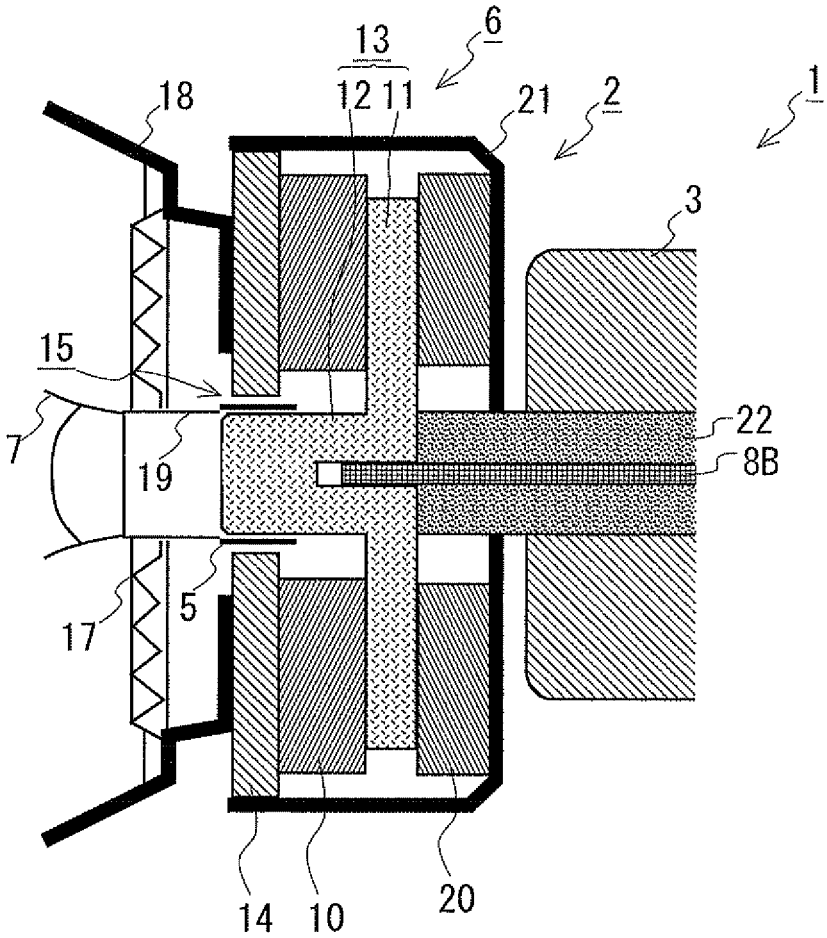
FIG. 2 An enlarged view of principal portions, illustrating a magnetic circuit unit of the speaker device according to the first embodiment and peripheral portions thereto.

FIG. 2 is an enlarged view of principal portions, showing the magnetic circuit unit 6 and peripheral portions thereto in the internal structure of the speaker device 1 depicted in FIG. 1. The speaker device 1 includes, as depicted in FIG. 2, a so-called external magnet type of magnetic circuit unit 6 having an annular main magnet 10. The magnetic circuit unit 6 has a center pole 13 constructed of a disc-shaped yoke 11 and a cylindrical pole 12 protruding from the central portion of the yoke 11, and an annular plate 14 extending circumferentially around the pole 12. The annular plate 14 extending circumferentially around the pole 12 forms a gap 15 defined as a minute gap between the pole 12 and the plate 14 itself. Further, a main magnet 10 is disposed in the way of being interposed between the plate 14 and the yoke 11. The main magnet 10 is classified as a permanent magnet. Herein, each of the center pole 13 and the plate 14 is composed of ferromagnetic iron. Hence, the magnetic circuit unit 6 is constructed of the main magnet 10, the yoke 11, the pole 12, the gap 15 and the plate 14, thereby configuring the magnetic circuit extending via these components in this sequence and looping back again to the main magnet 10. Note that the main magnet 10 is disposed so that the S-pole is directed to the front surface of the speaker device 1, while the N-pole is directed to the rear surface thereof.

A frame 18, which holds the diaphragm 7, is fixed to the front surface of the plate 14. The diaphragm 7 is coupled to the frame 18 via an edge 16 composed of a deformable elastic member attached to the outer peripheral side thereof and a damper 17 attached to the inner peripheral side thereof, in which the edge 16 and the damper 17 are movable relatively to the magnetic circuit unit 6 within a fixed range of deformability. The diaphragm 7 includes a bobbin 19 wound with the voice coil 5 at the central portion thereof, and the bobbin 19 and the voice coil 5 are inserted into the gap 15. A magnetic field generated by the magnetic circuit unit 6 is formed in the gap 15, whereby the electricity, upon flowing to the voice coil 5, produces a force acting to drive the diaphragm 7 in to-and-fro directions. To be specific, when the electric voice signals flow to the voice coil 5, interaction between the magnetic field in the gap 15 and the voice coil 5 through which the electric voice signals flow causes the vibrations based on waveforms of the electric voice signals.

Note that an annular cancel magnet 20 is disposed so as to abut on the rear surface of the yoke 11 in a state where the N-pole is directed to the front surface, while the S-pole is directed to the rear surface. The cancel magnet 20 is the permanent magnet. Further, a cylindrical shield cover 21, of which one end opens, internally accommodates the cancel magnet 20 and the magnetic circuit unit 6 to attain a configuration for preventing magnetism of the magnetic circuit unit 6 from leaking to the periphery. Note that a central portion of the shield cover 21 is formed with a hole for enabling the yoke 11 and the anchor 3 to be joined together.

Herein, the speaker unit 2 is joined to the anchor 3 via a spacer 22 and the fixing screw 85. To be specific, a screw hole of the fixing screw 8B is formed in the central portion of the rear surface of the yoke 11, and the speaker unit 2 is joined to the anchor 3 so that the spacer 22 fitting into the hole of the anchor 3 abuts on the rear surface. Thus, the yoke 11 of the speaker unit 2 is joined to the anchor 3, whereby the reaction force applied to the diaphragm 7 from the ambient air when the diaphragm 7 vibrates to produce the sound in the periphery, is transferred to the magnetic circuit unit 6 via the frame 18 and the voice coil 5, thereby vibrating the magnetic circuit unit 6. The anchor 3 having the predetermined mass is, however, fixed via the spacer 22 to the yoke 11 of the magnetic circuit unit 6, and hence the reaction force transferred to the magnetic circuit unit 6 from the diaphragm 7 is thoroughly cancelled by the mass of the anchor 3, thus restraining a decline of sound quality of the speaker device 1, which is derived from the vibrations of the magnetic circuit unit 6. It is to be noted that the predetermined mass is defined as a mass capable of contributing to maintain the sound quality of the speaker device 1 in a way that resists the reaction force received by the magnetic circuit unit 6 due to the vibrations of the diaphragm 7.

Figure 3:
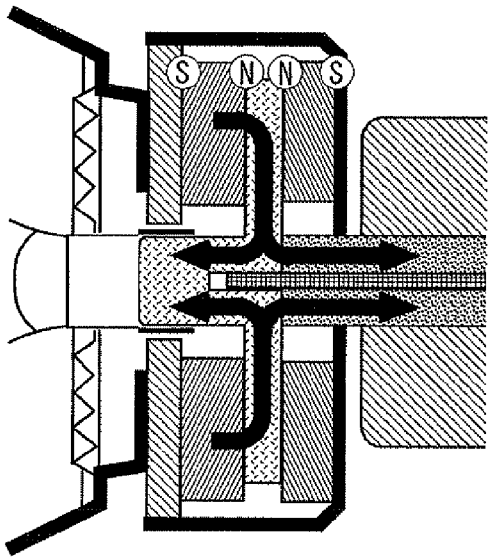
FIG. 3 A view depicting a flow of a magnetic flux when a spacer is composed of a ferromagnetic substance.
Figure 4:
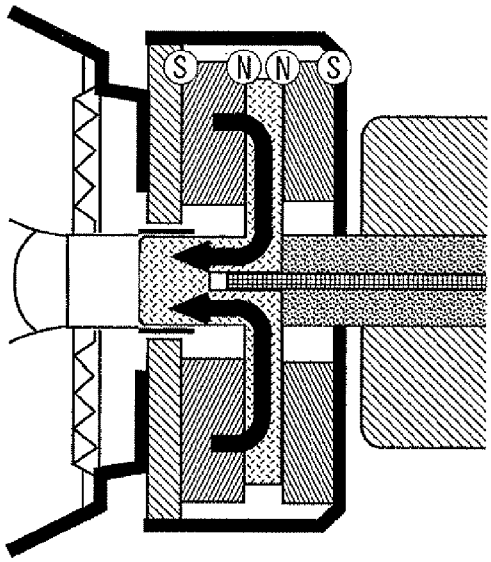
FIG. 4 A view depicting the flow of the magnetic flux in the speaker device according to the first embodiment.

By the way, the spacer 22 is composed of aluminum defined as a nonmagnetic substance. Herein, supposing that the spacer 22 is composed of ferromagnetic iron etc, it follows that a part of magnetic flux reaches the anchor 3 via the spacer 22 to generate a magnetic field in the periphery to the speaker device 1 (see FIG. 3). In the speaker device 1 according to the first embodiment, however, the spacer 22 is composed of nonmagnetic aluminum and controls a role as a magnetic resistor, with the result that the magnetic flux does not, as depicted in FIG. 4, flow to the anchor 3 from the magnetic circuit unit 6. Accordingly, if configured originally, some of the magnetic flux, which should contribute to generate the magnetic field in the gap 15, does not flow round to the anchor 3, and hence it never happens that an intensity of the magnetic field generated in the gap 15 is attenuated. As a result, a space (corresponding to a predetermined space according to the present invention) serving to separate magnetically the anchor 3 and the magnetic circuit unit 6 from each other, is formed between the anchor 3 and the magnetic circuit unit 6.

The speaker device 1 configured as described above restrains the magnetic circuit unit 6 from being affected by the vibrations and by the magnetism as well and can therefore reproduce the high-quality sound. Further, the magnetism leaking to the periphery of the speaker device 1 is also reduced, and it is therefore feasible to satisfy the magnetic shielding standards etc. It should be noted that aluminum is exemplified as the nonmagnetic material for the spacer 22 in the first embodiment, however, the present invention is not limited to the material such as this. The nonmagnetic material usable for the spacer 22 can involve using, e.g., brass, a resin, etc. Moreover, in the first embodiment, as to the polarities of the main magnet 10, the main magnet 10 is disposed so that the S-pole is directed to the front surface, while the N-pole is directed to the rear surface, however, the polarities may also be reversed. In this case, the polarity of the cancel magnet 20 needs reversing. Further, in the first embodiment, the material of the fixing screw 88 involves using iron defined as the ferromagnetic material, however, the fixing screw 8B may also be composed of stainless steel etc defined as the nonmagnetic material in the same way as the spacer 22 is composed. If the fixing screw 88 is composed of the nonmagnetic material, the magnetism flowing round to the anchor 3 from the magnetic circuit unit 6 can be restrained more surely. Furthermore, in the first embodiment, the speaker device 1 is configured by use of the external magnet type of magnetic circuit unit 6, however, the present invention is not limited to this configuration, and the speaker device 1 can be also configured by employing, e.g., a so-called internal magnet type of magnetic circuit unit.

Figure 5:
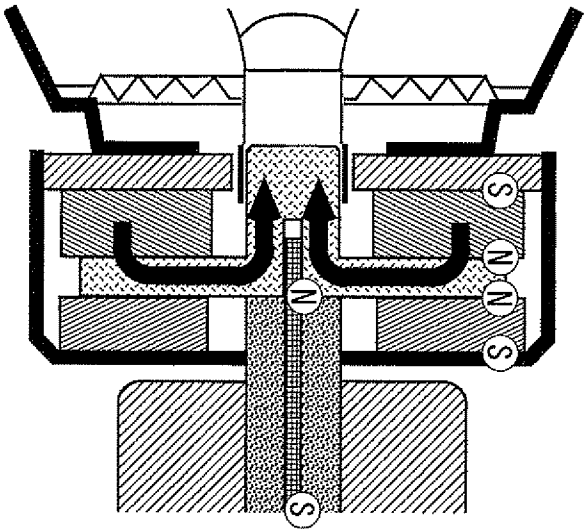
FIG. 5 A view depicting the flow of the magnetic flux in the speaker device according to a modified example of the first embodiment.

Moreover, in the first embodiment, the spacer 22 is composed of the nonmagnetic material, however, the present invention is not restricted to this type of material. For example, the spacer 22 may also be composed of the magnetic material such as the permanent magnet. FIG. 5 is a view illustrating a flow of the magnetic flux in a case where the spacer 22 is composed of the permanent magnet. In this modified example, the permanent magnet is used for the spacer 22, however, the polarities of the spacer 22 are set in the same directions as the directions of the polarities of the cancel magnet 20. To be specific, the polarities of the spacer 22 are set in such a state that the N-pole is directed to the front surface, while the S-pole is directed to the rear surface. The spacer 22 is, similarly to the cancel magnet 20, disposed in a manner that prevents the magnetism from leaking out of the magnetic circuit unit 6, whereby it is feasible to exhibit the same operational effects as in the first embodiment where the spacer 22 is composed of the nonmagnetic material. The magnetic flux of the spacer 22 performing the roles as the cancel magnet 20 flows through the anchor 3, and consequently the magnetic shielding performance of the speaker device 1 is slightly inferior to the performance in the first embodiment. The magnetism of at least the magnetic circuit unit 6 is, however, restrained from flowing round to the anchor 3, and therefore the intensity of the magnetic field in the gap 15 can be sufficiently kept.

Figure 6A:
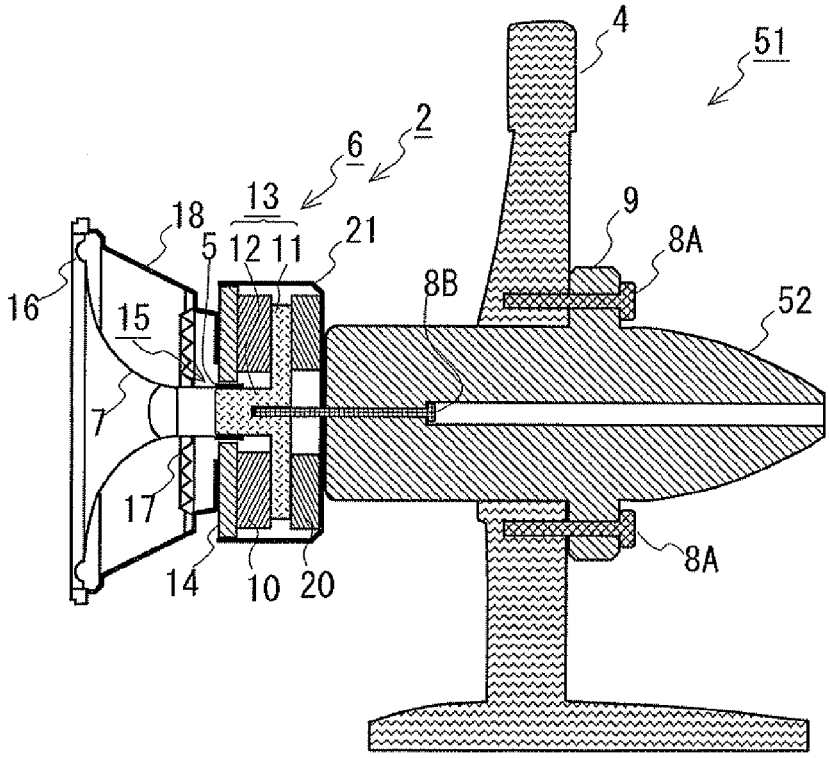
FIG. 6A A view of an internal structure of the speaker device according to a second embodiment.

FIG. 6A is a view depicting an internal structure when the speaker device 1 according to a second embodiment is viewed from the right side. The same components as those in the first embodiment are marked with the same nomenclatures and symbols, and in-depth descriptions thereof are omitted. A speaker device 51 according to the second embodiment includes, similarly to the speaker device 1 according to the first embodiment, as depicted in FIG. 6A, the speaker unit 2, an anchor 52 which suppresses the vibrations of the speaker unit 2, and the stay 4 which supports these components. The speaker unit 2 and the stay 4 have the same configurations as those in the first embodiment discussed above, and hence their explanations are omitted.

The anchor 52 of the speaker device 51 according to the second embodiment is, unlike the anchor 3 of the speaker device 1 according to the first embodiment, formed with none of the hole into which the spacer 22 is fitted. Other points are the same as these of the anchor 3 according to the first embodiment. Then, the speaker device 51 according to the second embodiment is configured such that the anchor 52 and the speaker unit 2 are, as illustrated in FIG. 6A, joined together without via the spacer 22 used in the speaker device 1 according to the first embodiment. Hence, the front surface of the anchor 52 abuts on the rear surface of the shield cover 21 of the speaker unit 2.

According to the thus-configured speaker device 51, the vibrations of the magnetic circuit unit 6 are transferred to the anchor 52 via the cancel magnet 20 and the shield cover 21. Hence, the reaction force propagated to the magnetic circuit unit 6 from the diaphragm 7 are thoroughly canceled by the mass of the anchor 52, whereby it is possible to restrain the sound quality of the speaker device 51 from declining due to the vibrations of the magnetic circuit unit 6. Further, the magnetism flowing round to the anchor 52 from the magnetic circuit unit 6 is restrained by the cancel magnet 20, thereby restraining the attenuation of the intensity of the magnetic field in the gap 15, which is derived from the action that the magnetism of the magnetic circuit unit 6 flows round to the anchor 52. Accordingly, this speaker device 51 is restrained from being affected by the vibrations and the magnetism of the magnetic circuit unit 6 and can therefore reproduce the high-quality sound.

Note that the nonmagnetic material such as aluminum and brass is, it is preferable, used as the material of the fixing screw 8B, however, the ferromagnetic material such as iron can be also employed in the second embodiment. Further, in the second embodiment, the shield cover 21 is interposed between the anchor 52 and the cancel magnet 20, however, the present invention is not limited to the embodiment such as this. Namely, the anchor 52 may be brought into direct contact with the cancel magnet 20.

Figure 6B:
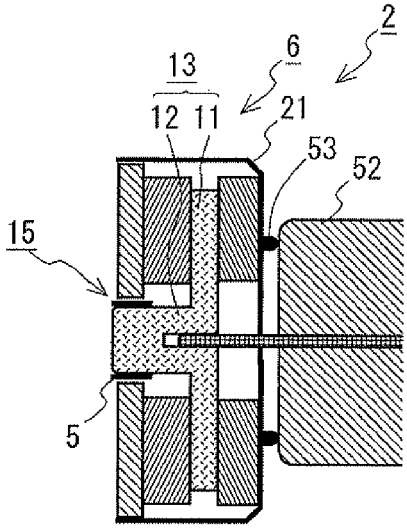
FIG. 6B An enlarged view of the principal portions, illustrating the magnetic circuit unit of the speaker device according to the second embodiment and the peripheral portions thereto.

Moreover, the second embodiment exemplifies the surface contact between the shield cover 21 and the anchor 52 in FIG. 6A, however, the present invention is not restricted to this contact mode. For example, as illustrated in FIG. 6B, the shield cover 21 may be provided with an annular rib 53 for reducing a contact area between the shield cover 21 and the anchor 52. The rib 53 causes magnetic resistance between the shield cover 21 and the anchor 52, and hence the cancel magnet 20 more effectively restrains the magnetic flux leaking out of the magnetic circuit unit 6, thereby enabling the intensity of the magnetic field in the gap 15 to be increased.

Figure 7:
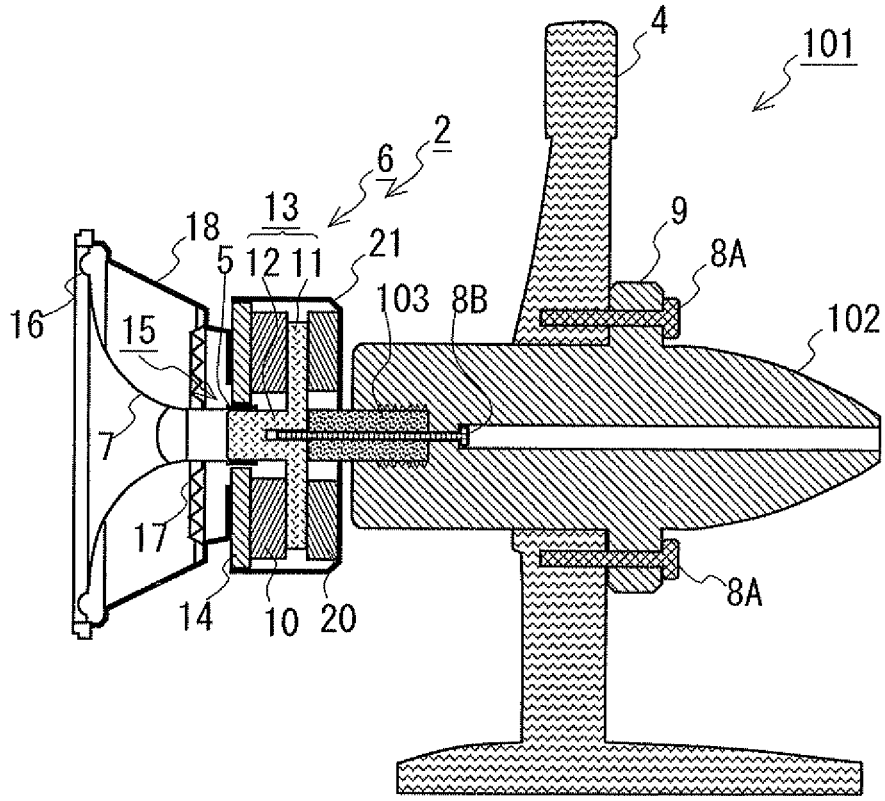
FIG. 7 A view of an internal structure of the speaker device according to a third embodiment.

FIG. 7 is a view depicting an internal structure when a speaker device 101 according to a third embodiment is viewed from the right side. The same components as those in the first embodiment are marked with the same nomenclatures and symbols, and in-depth descriptions thereof are omitted. A speaker device 101 according to the third embodiment includes, similarly to the speaker device 1 according to the first embodiment, as depicted in FIG. 7, the speaker unit 2, an anchor 102 which suppresses the vibrations of the speaker unit 2, and the stay 4 which supports these components. The speaker unit 2 and the stay 4 have the same configurations as those in the first embodiment discussed above, and hence their explanations are omitted.

Figure 8:
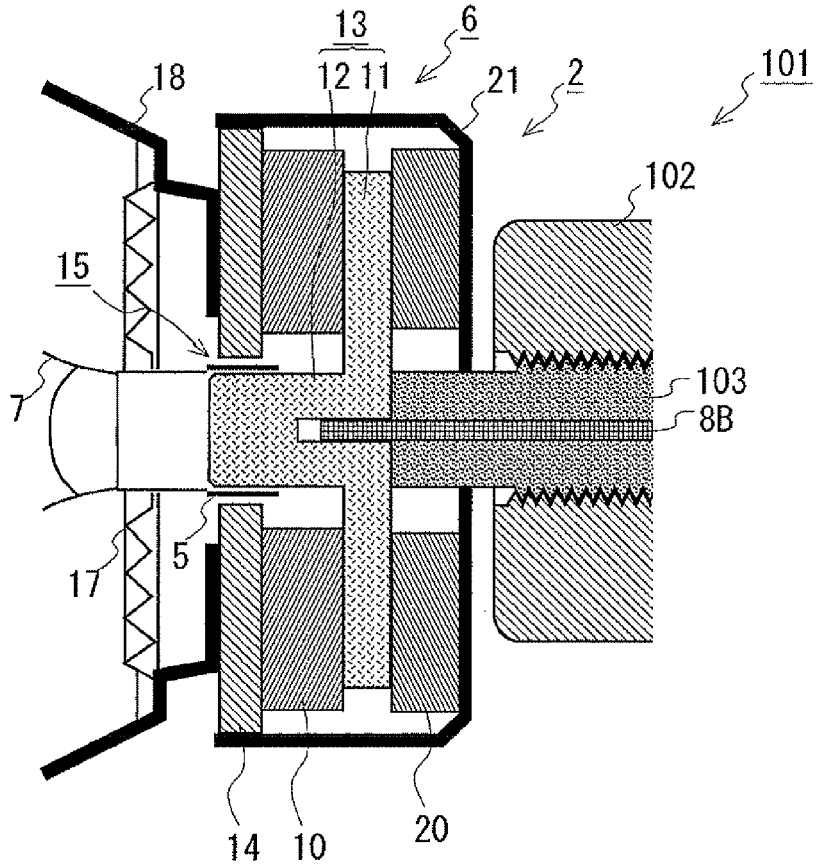
FIG. 8 An enlarged view of the principal portions, illustrating the magnetic circuit unit of the speaker device according to the third embodiment and the peripheral portions thereto.

FIG. 8 is an enlarged view of the principal portions, depicting in enlargement the magnetic circuit unit 6 of the speaker device 101 according to the third embodiment and the peripheral portions thereof. The anchor 102 of the speaker device 101 according to the third embodiment is, unlike the anchor 3 of the speaker device 1 according to the first embodiment, formed with a screw hole as the hole into which the spacer 22 is fitted. Further, the anchor 102 and the speaker unit 2 are joined together via a spacer 103 having a screw portion. The speaker device 101 according to the third embodiment is capable of adjusting an interspace between the speaker unit 2 and the anchor 102 by rotating the spacer 103.

If the interspace between the speaker unit 2 and the anchor 102 is narrowed, the magnetism leaking to the anchor 102 from the magnetic circuit unit 6 rises, and therefore the magnetic field in the gap 15 weakens, while on the other hand the vibrations of the magnetic circuit unit 6 can be restrained more effectively. Whereas if the interspace between the speaker device 101 and the anchor 102 is expanded, the effect in suppressing the vibrations of the magnetic circuit unit 6 is slightly lost, while on the other hand the magnetism leaking to the anchor 102 from the magnetic circuit unit 6 decreases, resulting in an increased magnetic field in the gap 15. Incidentally, in the case of desiring to narrow the interspace between the speaker unit 2 and the anchor 102, after demounting the speaker unit 2 from the anchor 102 by removing the fixing screw 8B, the screwing is done by rotating the spacer 103 rightward, and the speaker unit 2 is fixed again to the anchor 102 with the fixing screw 8B. By contrast, in the case of desiring to expand the interspace between the speaker unit 2 and the anchor 102, after demounting the speaker unit 2 from the anchor 102 by removing the fixing screw 8B, the screw is protruded on the near side by rotating the spacer 103 leftward, and the speaker unit 2 is fixed again to the anchor 102 with the fixing screw 8B.

Figure 9:
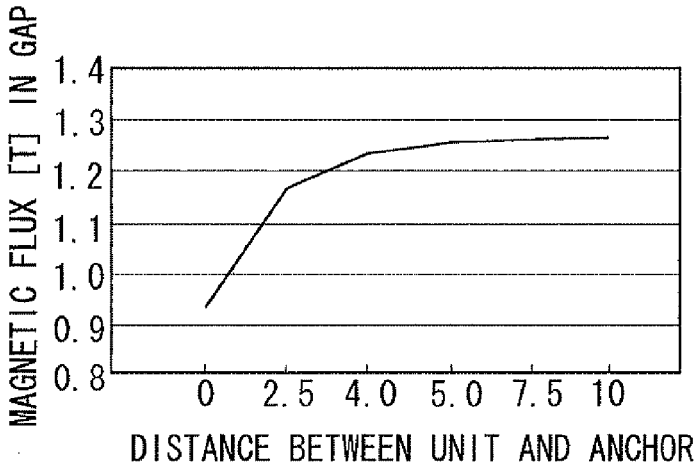
FIG. 9 A graphic chart illustrating a correlation between a magnetic flux in a gap and a distance between a speaker and an anchor.

The speaker device 101 according to the third embodiment is capable of adjusting the interspace between the speaker unit 2 and the anchor 102 and can therefore reproduce, in addition to the same operational effects in the respective embodiments, the high-quality sound by adjusting dispersion in acoustic characteristics on a per-product basis. FIG. 9 is a graphic chart showing a correlation between the magnetic flux in the gap 15 and a distance between the speaker unit 2 and the anchor 102. As depicted in FIG. 9, a degree of how much the interspace between the speaker unit 2 and the anchor 102 gets expanded contributes to improve the intensity of the magnetic field in the gap 15, however, the effect thereof weakens stepwise. Hence, if the interspace between the speaker unit 2 and the anchor 102 is adjustable as in the third embodiment, both of the speaker unit 2 and the anchor 102 can be adjusted in such a positional relation as to attain the optimal sound quality from the correlation between the vibration restraining effect and the intensity improving effect of the magnetic field in the gap 15.

Note that the means for adjusting the interspace between the anchor 102 and the speaker unit 2 is not limited to what is realized by the spacer 103 having the screw unit such as this. For example, an available means may involve adjusting the interspace between these two components by interposing a thin plate for adjusting the interspace together with the spacer 103 between the speaker unit 2 and the anchor 102 and may also involve preparing a multiplicity of spacers 103 having a variety of sizes and selecting the optimal spacer 103.

The invention claimed is:

1. A speaker device for use with a vibration unit that includes a coil through which electric sounds flow, such that vibrations of the vibration unit produce a sound, the speaking device comprising:

a magnetic circuit unit to generate a magnetic field for vibrating the vibration unit;

an anchor portion to be fixed to the magnetic circuit unit and to restrain the vibrations of the magnetic circuit unit that receives a reaction force caused by the vibrations of the vibration unit, and a joint portion that attaches the magnetic circuit unit and the anchor portion together in a way that forms a predetermined space for magnetically separating the magnetic circuit unit and the anchor portion from each other between the magnetic circuit unit and the anchor position;

wherein the magnetic circuit unit includes a magnet portion and a yoke portion to guide a magnetic flux of the magnet portion to a space in which the coil is disposed, and wherein the joint portion attaches the magnetic circuit unit and the anchor portion together in such a state that a spacer composed of a nonmagnetic material is interposed between the yoke portion and the anchor portion, and the spacer, composed of a member that differs from the anchor portion, is in contact with both the magnetic circuit and the anchor portion.

2. The speaker device according to claim 1, wherein the anchor portion is fixed to the magnetic circuit unit in such a state that a distance between the magnetic circuit unit and the anchor portion is adjusted based on a correlation between an intensity of the magnetic field generated in the space where the coil is disposed and a vibration suppressing effect of the magnetic circuit unit, depending on a length of the spacer in a direction of extending to the anchor portion from the magnetic circuit unit.

3. A speaker device for use with a vibration unit that includes a coil through which electric sounds flow, such that vibrations of the vibration unit produce a sound, the speaking device, comprising:

a magnetic circuit unit to generate a magnetic field for vibrating the vibration unit;

an anchor portion to be fixed to the magnetic circuit unit and to restrain the vibrations of the magnetic circuit unit that receives a reaction force caused by the vibrations of the vibration unit; and a joint portion that attaches the anchor portion and the magnetic circuit unit together in a way that forms a predetermined space for magnetically separating the magnetic circuit unit and the anchor portion from each other between the magnetic circuit unit and the anchor portion, wherein the magnetic circuit unit includes a magnet portion and a yoke portion to guide a magnetic flux of the magnet portion to a space in which the coil is disposed, and wherein the joint portion attaches the magnetic circuit unit and the anchor portion together in such a state that a magnetic shielding portion to restrain a magnetic flux leaking from the magnetic circuit unit is interposed between the yoke portion and the anchor portion, and the magnetic shielding portion is in contact with the anchor portion.

4. The speaker device according to claim 1, further comprising a screw composed of a nonmagnetic material, the anchor portion being fastened to the magnetic circuit unit by the screw.

5. The speaker device according to claim 2, further comprising a screw composed of a nonmagnetic material, the anchor portion being fastened to the magnetic circuit unit by the screw.

6. The speaker device according to claim 3, further comprising a screw composed of a nonmagnetic material, the anchor portion being fastened to the magnetic circuit unit by the screw.

* * * * *